US005407749A

United States Patent [19]

Bishop

[11] Patent Number: 5,407,749

[45] Date of Patent: Apr. 18, 1995

[54] IRIDESCENT CHROMIUM COATINGS AND METHOD

[75] Inventor: Craig V. Bishop, Lakewood, Ohio

[73] Assignee: McGean-Rohco, Inc., Cleveland, Ohio

[21] Appl. No.: 284,378

[22] Filed: Aug. 2, 1994

Related U.S. Application Data

[62] Division of Ser. No. 133,640, Oct. 7, 1993.

[51] Int. Cl.[6] ..... C23C 22/08

[52] U.S. Cl. ..... 428/472.1; 148/258

[58] Field of Search ..... 428/472.1; 148/258

[56] References Cited

U.S. PATENT DOCUMENTS

| | | | |
|---|---|---|---|
| 3,501,352 | 3/1970 | Shah | 148/6.2 |
| 3,535,168 | 10/1970 | Thompson | 148/6.16 |
| 3,647,569 | 3/1972 | Schneider | 148/6.16 |
| 3,932,198 | 1/1976 | Schneider | 148/6.2 |
| 4,026,728 | 5/1977 | Yoshida et al. | 148/6.14 R |
| 4,141,758 | 2/1979 | Glassman et al. | 148/6.2 |
| 4,171,231 | 10/1979 | Bishop et al. | 148/6.21 |
| 4,263,059 | 4/1981 | Guhde et al. | 148/6.2 |
| 4,407,899 | 10/1983 | Hara et al. | 428/626 |
| 4,411,964 | 10/1983 | Hara et al. | 428/626 |
| 4,578,122 | 3/1986 | Crotty | 148/6.2 |
| 4,657,599 | 4/1987 | Sutherland | 148/6.2 |
| 4,689,085 | 8/1987 | Plueddemann | 106/287.14 |
| 5,001,011 | 3/1991 | Plueddemann | 428/447 |
| 5,073,456 | 12/1991 | Palladino | 428/446 |
| 5,101,055 | 3/1992 | Dinh et al. | 556/413 |
| 5,108,793 | 4/1992 | van Doiy et al. | 427/327 |

FOREIGN PATENT DOCUMENTS

| | | |
|---|---|---|
| 586517 | 3/1947 | United Kingdom . |
| 1461244 | 1/1977 | United Kingdom . |

*Primary Examiner*—Sam Silverberg
*Attorney, Agent, or Firm*—Renner, Otto, Boisselle & Sklar

[57] ABSTRACT

A method is described for producing an iridescent chromium coating on a zinc-nickel alloy surface containing at least about 8% nickel in the alloy. The method of the invention comprises (A) contacting said surface with an aqueous acidic solution maintained at a temperature of from about 38° C. to about 75° C., wherein the solution comprises trivalent chromium as substantially the only chromium ion present, and a phosphorus acid selected from phosphoric acid, phosphorous acid, hypophosphorous acid and mixtures thereof in an amount effective to provide a solution having a pH of from about 1.0 to about 2.5; and (B) drying the surface.

Metal articles having zinc-nickel alloy surfaces containing at least about 8% nickel in the alloy which have been treated in accordance with the method of the invention exhibit the desired iridescent coating and are characterized by improved corrosion resistance.

6 Claims, No Drawings

IRIDESCENT CHROMIUM COATINGS AND METHOD

This is a division of application Ser. No. 08/133,640, filed Oct. 1993.

FIELD OF THE INVENTION

The present invention relates to a method of producing iridescent chromium coatings on zinc-nickel alloy surfaces, and to articles having such surfaces. More particularly, the invention relates to a process for producing iridescent chromium coatings on zinc-nickel alloy surfaces containing at least about 8% by weight of nickel in the alloy. The invention also relates to metal articles having such iridescent surfaces.

BACKGROUND OF THE INVENTION

Various conversion coatings on metal surfaces have been suggested in the prior art for the purpose of forming a coating which protects the metal against corrosion and also serves as a base for improving the adhesion of subsequently applied siccative organic finishes. Such conversion coatings are applied by treatment of the surfaces with solutions of various chemicals which react with the surface to form the desired coating. Among the commonly used conversion coating compositions are aqueous phosphate and chromate solutions. Among the simplest of the phosphate compositions are the so-called iron phosphates which comprise, for example, solutions of alkali metal phosphates, and which react with the iron on the metal surface to form an iron phosphate coating.

It also has long been known that surfaces of zinc and zinc-based alloys can be protected against corrosion by treatment with an acid solution containing hexavalent chromium. It was suggested that the attack of the solution on the surface was facilitated if the solution initially contained a small amount of trivalent chromium, and it has been proposed to introduce this trivalent chromium by adding a compound of trivalent chromium, or preferably by adding a small amount of a suitable reducing agent. As the solutions are used, more trivalent chromium is formed by reduction of hexavalent chromium at the zinc surfaces so that the concentration of trivalent chromium progressively increases and the solution eventually has to be discarded when the quality of the coating is affected by the deterioration of the solution. Examples of patents which describe solutions containing mixtures of trivalent chromium and hexavalent chromium include U.S. Pat. Nos. 3,880,772; 3,795,549; 3,553,034; 3,404,046; 3,090,710; 2,911,332; and 2,902,392.

The treatment of zinc surfaces with solutions wherein chromium is entirely in a trivalent state is disclosed in, for example, U.S. Pat. Nos. 3,932,198; 3,647,569; 3,501,352; and 2,559,878. Trivalent chromium solutions also are disclosed in British Patent 1,461,244.

One disadvantage of hexavalent chromium type solutions is in the area of waste disposal. Emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive, and the precipitate creates a disposal problem.

Another problem which has been observed with chromate finishes which have been described previously is the unacceptable adhesion characteristics when certain paints have been applied over the chromate coatings, particularly on exposure to salt spray.

Chromate coating solutions containing trivalent chromium as substantially the only chromium ion present, fluoride ion, an acid other than nitric acid and an oxidizing agent such as an inorganic halate or peroxide have been described in U.S. Pat. No. 4,171,231. Such solutions deposit desirable light to clear blue chromate finishes.

U.S. Pat. No. 4,263,059 describes aqueous acidic chromate coating solutions for treating zinc, zinc alloy or cadmium surfaces which comprises trivalent chromium as substantially the only chromium ion present, fluoride ion and an acid wherein the coating solution is prepared by mixing a green trivalent chromium ion solution with a blue trivalent chromium ion solution having a pH of less than 1. The blue trivalent chromium solution can be prepared by dissolving a source of hexavalent chromium in water and adding a reducing agent to reduce the hexavalent chromium to trivalent chromium and thereafter adding fluoride ion and an acid to reduce the pH to less than 1. The acids may be organic acids such as acetic acid or inorganic acids such as nitric acid, sulfuric acid, hydrochloric acid, sulfamic acid and phosphoric acid.

U.S. Pat. No. 4,026,728 describes coatings for steel sheet including zinc plated steel, chromium-plated steel, aluminum-plated steel, etc. with a solution containing at least one compound selected from the group consisting of chromic acid, phosphoric acid, salts of chromium, molybdenum, silicon, cobalt, manganese, copper, nickel, aluminum and titanium, and thereafter contacting the treated steel with a solution containing at least one organic silicon compound.

U.S. Pat. Nos. 2,559,878; 3,647,569; and 3,932,198 describe solutions for coating metal surfaces which comprise trivalent chromium and nitric acid. In the '198 patent, the solutions also must contain one or more cations selected from the group consisting of manganese, bismuth, antimony, tin, zinc or molybdenum.

SUMMARY OF THE INVENTION

A method is described for producing an iridescent chromium coating on a zinc-nickel alloy surface containing at least about 8% nickel in the alloy. The method of the invention comprises.

(A) contacting said surface with an aqueous acidic solution maintained at a temperature of from about 38° C. to about 75° C., wherein the solution comprises trivalent chromium as substantially the only chromium ion present, and a phosphorus acid selected from phosphoric acid, phosphorous acid, hypophosphorous acid and mixtures thereof in an amount effective to provide a solution having a pH of from about 1.0 to about 2.5; and (B) drying the surface.

Metal articles having zinc-nickel alloy surfaces containing at least about 8% nickel in the alloy which have been treated in accordance with the method of the invention exhibit the desired iridescent coating and are characterized by improved corrosion resistance.

DESCRIPTION OF THE PREFERRED EMBODIMENTS

The method of the present invention is useful in producing iridescent chromium coatings on zinc-nickel alloy surfaces wherein the alloy contains at least about 8% by weight of nickel. Generally, the alloys may contain from about 8% to about 20% by weight of nickel. More often, the alloy will contain from about 9% to about 16% by weight of nickel. Specific examples of zinc-nickel alloys which can be provided with an iridescent coating include zinc-nickel alloys containing 10% nickel, zinc-nickel alloys containing 12% nickel, zinc-nickel alloys containing 16% nickel, etc.

The aqueous acidic solutions which are useful in the method of the present invention comprise trivalent chromium as substantially the only chromium ion present, and an amount of a phosphorus acid selected from phosphoric acid, phosphorous acid, hypophosphorous acid and mixtures thereof which is effective to provide a solution having a pH of from about 1.0 to about 2.5. The solutions generally will contain from about 0.5 to about 20 grams of trivalent chromium per liter of solution and more often will contain from about 1 to about 15 grams of trivalent chromium per liter of solution. The trivalent chromium contained in the aqueous acidic solutions may be derived from a number of sources including chromium (III) sulfate, chromium (III) nitrate, chromium (III) phosphate, chromium (III) acetate, chromium (III) chloride, etc.

The trivalent chromium also can be prepared by the reduction of an aqueous hexavalent chromium-containing solution. Various water-soluble or water-dispersible sources of hexavalent chromium may be used in the preparation of the trivalent chromium solution provided that the anions or cations introduced with the hexavalent chromium do not have a detrimental effect on either the solution itself or on the zinc-nickel or zinc-iron surfaces. Examples of hexavalent chromium materials which may be used are chromic acid ($CrO_3$), the alkali metal chromates such as sodium chromate and potassium chromate, the alkali metal dichromates such as sodium dichromate and potassium dichromate, etc.

Methods for reducing hexavalent chromium with organic and inorganic reducing agents are generally known in the art. For example, U.S. Pat. Nos. 3,063,877 and 3,501,352 describe methods for reducing chromium trioxide with aldehydes and alcohols such as formaldehyde and butyl alcohol. However, the amount of reducing agent used in accordance with those patents is insufficient for completed reduction of the hexavalent chromium as required in the present invention. Accordingly, the amount of reducing agent used in preparing trivalent chromium for use in the present invention is at least the amount required for complete reduction of the hexavalent chromium to trivalent chromium.

Among the suitable inorganic reducing agents are alkali metal iodides, ferrous salts, sulfur dioxide, hydrogen peroxide, and alkali metal sulfites, bisulfites and metabisulfites. The alkali metal bisulfites, and especially sodium and potassium metabisulfite are preferred. As mentioned above, the reducing agents are employed in amounts sufficient to completely reduce hexavalent to trivalent chromium. In general, the amount of sulfite or bisulfite employed is less than 1% excess (by weight) or with the stoichiometric amount required for complete reduction of hexavalent to trivalent chromium. However, an excess of bisulfite is not detrimental to this invention.

A preferred procedure for preparing trivalent chromium solutions which may be used in the preparation of the coating solutions of the invention is described in British Patent 1,461,244 and U.S. Pat. No. 4,171,231. A source of hexavalent chromium such as chromic acid flakes is dissolved in water, and the reducing agent is added slowly to control the heat of the reaction and to maintain the reaction mixture at the desired temperature. Cooling may be required if the addition progresses too rapidly.

The aqueous acidic solutions used in the present invention contain at least one phosphorus acid selected from phosphoric acid, phosphorous acid, and hypophosphorous acid. Sufficient phosphorus acid is included in the aqueous acidic solutions used in the present invention to provide a solution having a pH of from about 1.0 to about 2.5, more often, from about 1.0 to 2.0 or from about 1.2 to about 1.6. In one preferred embodiment, the phosphorus acid included in the aqueous acidic solutions is phosphoric acid.

The aqueous acidic solutions utilized in the present invention for producing iridescent chromium coatings on zinc-nickel alloy surfaces may also contain one or more sources of halide ion or mixtures of halide ions. More particularly, fluoride, ions, chloride ions or mixtures of chloride and fluoride ions can be included in the aqueous acidic solutions. The amount of halide ion(s) included in the solutions may range from 0 to about 10 g/l, and more often is in the range of about 1 to about 5 g/l.

The source of fluoride ion may be any soluble fluoride compound so long as the ions introduced with the fluoride ion are not detrimental to the performance of the solution. Either metal or ammonium fluorides may be used. Typical fluoride materials include hydrofluoric acid, alkali metal or ammonium fluorides such as sodium fluoride, ammonium fluoride, etc., and alkali metal or ammonium hydrogen fluorides such as sodium hydrogen fluoride, ammonium hydrogen fluoride (ammonium bifluoride), etc. Since high water-solubility is desired whenever possible, highly soluble fluorides such as the sodium or ammonium bifluorides are preferred. The aqueous acidic solutions utilized in the present invention may contain from 0 to about 2 grams, more often from about 0.5 to about 1.5 grams of fluoride per liter of solution. Sources of chloride ions include metal chlorides including alkali metal and the Group II metals provided they are soluble in the acidic solution and they do not introduce ions which are detrimental to the performance of the solution. Zinc chloride is a specific example of a useful chloride ion source. The amount of chloride which can be incorporated into the aqueous acidic solution may range from 0 to about 4 grams and more often from about 1 to about 3.5 grams of chloride ion per liter of solution.

Nitrate ions also may be included in the aqueous acidic solutions utilized in the present invention. The source of nitrate ion may be any soluble nitrate compound so long as the ions introduced with the nitrate ion are not detrimental to the performance of the solution. Typical nitrate materials include alkali metal and ammonium nitrates such as sodium nitrate, potassium nitrate, ammonium nitrate, etc. Aqueous acidic solutions utilized in the present invention may contain from 0 up to about 10 grams of nitrate ion per liter of solution.

The aqueous acidic solutions utilized in the process of the present invention are free of hexavalent chromium. The aqueous acidic solutions also may be free of peroxides and inorganic halates.

The following examples illustrate specific aqueous acidic solutions which are useful in the process of the present invention and which produce iridescent chromate coatings in zinc-alloy surfaces when the alloy contains at least about 8% by weight of nickel. Unless otherwise indicated in the following examples and elsewhere in the specification and claims, all parts and percentages are by weight, temperatures are in degrees Centigrade, and pressures are at or near atmospheric pressure.

| | Grams |
|---|---|
| Example A | |
| Basic chromium (III) chloride | 8.0 |
| Ammonium bifluoride | 1.5 |
| Zinc chloride | 0.5 |
| Sodium nitrate | 9.0 |
| Water to 1 hter | |
| $H_3PO_4$ (85%) to a pH of 1.2 | |
| Example B | |
| Basic chromium (III) chloride | 8.0 |
| Ammonium bifluoride | 1.5 |
| Zinc chloride | 0.5 |
| Sodium nitrate | 9.0 |
| Water to 1 liter | |
| $H_3PO_4$ (85%) to a pH of 1.6 | |
| Example C | |
| Basic chromium (III) chloride | 12.0 |
| Ammonium bifluoride | 1.0 |
| Zinc chloride | 0.5 |
| Sodium nitrate | 7.5 |
| Water to 1 liter | |
| $H_3PO_4$ (85%) to a pH of 2.0 | |

In the method of the present invention, the zinc-nickel surface usually is cleaned by chemical and/or physical means to remove any grease, dirt or oxides, although such treatments are not always required, particularly when the surface is to be treated with the aqueous acidic chromium solutions of the present invention immediately or soon after the zinc-nickel alloy has been deposited on a metallic substrate. After rinsing the surface with water, the surface is contacted with the aqueous acidic solutions of the present invention. Contact may be accomplished by any of the commonly used techniques such as dipping, spraying, brushing, roller-coating, reverse roller-coating and flow coating. The aqueous compositions of the present invention are particularly useful in dipping operations.

The aqueous acidic solutions are maintained at a temperature of from about 38° C. to about 75° C. and more often from about 40°–70° C. The temperature of the aqueous acidic solution is critical to this invention. When the temperature is below about 38° C., (e.g., 21° C.) the chromate coating which is formed on the zinc-nickel surface is clear, not iridescent. When the method of application is by dipping or immersion, a dipping or immersion time of about 15 seconds to about 2 minutes or more is sufficient.

Following the treatment with the aqueous acidic solution containing trivalent chromium and phosphorus acid at between about 38° C. to about 75° C., the metal surface may be dried, or the surface may be rinsed with water and then dried. Drying may be effected by air-blowing at room temperature or at higher temperatures, usually up to about 65° C.

The chromium coated surfaces also may be baked at an elevated temperature such as at about 70°–95° C. for one or two hours. Such baking treatments can provide the coatings with improved corrosion resistance. For example, improved corrosion resistance is exhibited by a coating which has been baked for about one hour at about 88° C. (190° F.). This result is surprising since baking of chromium conversion coatings generally accelerates failure of the coating.

The following examples illustrate the method of coating zinc-nickel surfaces with the aqueous acidic compositions in accordance with this invention.

EXAMPLE I

Steel panels coated with a zinc-nickel alloy containing about 12% nickel in the alloy are immersed in the aqueous acidic solution of Example A for about 0.25 to 2 minutes while maintaining the temperature of the solution at about 41° C. The panels are removed from the solution, rinsed with water and allowed to dry at room temperature. The chromium coating is an iridescent yellow.

EXAMPLE II

The procedure of Example I is repeated except that the panels are immersed in the solution of Example A at 60° C. The panels prepared in this manner have an iridescent yellow chromium coating.

EXAMPLE III

The procedure of Example I is repeated except that the steel panels are immersed in the aqueous acidic solution of Example A at 71° C. An iridescent yellow chromium-containing conversion coating is obtained.

EXAMPLE IV

The procedure of Example I is repeated except that the steel panels are immersed in the aqueous acidic solution of Example A at 41° C. and the panel is not rinsed with water before drying. An iridescent yellow chromium coating is obtained.

EXAMPLE V

The procedure of Example I is repeated except that the aqueous acidic solution of Example B is used at 44° C. An iridescent chromium coating is obtained.

EXAMPLE VI

The procedure of Example I is repeated except that the aqueous acidic solution of Example B is used at a temperature of 66° C. An iridescent chromium coating is obtained.

COMPARATIVE EXAMPLE I

The procedure of Example V is repeated except that the temperature of the solution is maintained at 21° C. A clear chromate coating is obtained.

COMPARATIVE EXAMPLE II

The procedure of Example V is repeated except that the steel panels are initially coated with a zinc-nickel alloy containing 6% nickel, and the temperature of the aqueous acidic solution is maintained at about 44° C. A clear chromate coating is obtained.

COMPARATIVE EXAMPLE III

The procedure of Example V is repeated except that the steel panels are initially coated with a zinc-nickel alloy containing 6% nickel. A clear chromate coating is obtained.

The iridescent chromium coatings produced in accordance with the method of the present invention provide improved corrosion resistance and paint adhesion. The improvement in corrosion resistance is demonstrated by subjecting the dried panels prepared in the above examples to a 5% neutral salt spray environment. The length of time required to develop white corrosion over 5% of the steel panels is observed and recorded. Corrosion at the edges of the panel is ignored. The results of these corrosion tests are summarized in the following table.

TABLE

White Corrosion Test Results

| Panel of Example | Color | Hours |
|---|---|---|
| I | Iridescent | 120 |
| II | Iridescent | 125 |
| III | Iridescent | 120 |
| IV | Iridescent | 220 |
| V | Iridescent | 234 |
| VI | Iridescent | 96 |
| Comparative Example I | Clear | 5 |
| Comparative Example II | Clear | 48 |
| Comparative Example III | Clear | 5 |

After a metal article having a zinc-nickel alloy surface has been treated in accordance with the method of the present invention, it often is preferred to apply an organic coating composition which may be a siccative coating such as a paint, lacquer, varnish, synthetic resin, or enamel, or electrostatically deposited powder coating. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction. The coated article is dried in a manner best suited for the siccative coating composition employed such as by air-drying at ambient or elevated temperature, baking in an oven, or baking under infrared lamps. In most instances, the thickness of the dried film of the siccative organic coating composition will be from about 0.1 to about 10 mils, and more often between 0.3 to about 5 mils.

From the above description, it will be apparent that the advantages which are obtained from the method of this invention include the ability to produce iridescent chromium-containing conversion coatings while eliminating the use of hexavalent chromium; improved corrosion resistance; and good paint adhesion.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An article having a zinc-alloy surface containing at least about 8% by weight of nickel which has been coated with an iridescent chromium coating by (A) contacting said surface with an aqueous acidic solution at a temperature of from about 40° C. to about 70° C., said solution comprising trivalent chromium as substantially the only chromium ion present, halide ion and a phosphorus acid selected from phosphoric acid, phosphorous acid, hypophosphorous acid and mixtures thereof in an amount effective to provide a solution having a pH of from about 1.0 to about 2.5;

(B) rinsing the surface with water; and (C) drying the surface.

2. The article of claim 1 wherein the aqueous acidic solution also contains chloride ions.

3. The article of claim 1 wherein the phosphorus acid is phosphoric acid.

4. The article of claim 1 wherein the solution used in (A) is substantially free of inorganic halates and peroxides.

5. The article of claim 1 wherein the aqueous acidic solution comprises from about 0.5 to about 20 grams per liter of trivalent chromium and from about 0.1 to about 2 grams per liter of halide ion of a different chloride, fluoride or mixtures thereof.

6. The article of claim 1 wherein the zinc-nickel alloy contains from about 9% to about 16% by weight of nickel.

* * * * *